US011112191B2

(12) United States Patent
Riebel et al.

(10) Patent No.: US 11,112,191 B2
(45) Date of Patent: Sep. 7, 2021

(54) HEAT EXCHANGER WITH TURBULATING INSERTS

(71) Applicant: Modine Manufacturing Company, Racine, WI (US)

(72) Inventors: Alexander Riebel, Stuttgart (DE); Mostafa Sharifi Khozani, Stuttgart (DE); Florian Dörr, Filderstadt (DE); Dieter Merz, Dotternhausen (DE)

(73) Assignee: MODINE MANUFACTURING COMPANY, Racine, WI (US)

( * ) Notice: Subject to any disclaimer, the term of this patent is extended or adjusted under 35 U.S.C. 154(b) by 72 days.

(21) Appl. No.: 16/385,663

(22) Filed: Apr. 16, 2019

(65) Prior Publication Data

US 2020/0333092 A1 Oct. 22, 2020

(51) Int. Cl.

| | |
|---|---|
| ***B21D 53/04*** | (2006.01) |
| ***F28F 13/12*** | (2006.01) |
| ***F28F 13/00*** | (2006.01) |
| ***F28F 3/02*** | (2006.01) |

(52) U.S. Cl.

CPC ..... *F28F 13/12* (2013.01); *B21D 53/04* (2013.01); *F28F 3/025* (2013.01); *F28F 13/003* (2013.01); *F28F 2275/12* (2013.01)

(58) Field of Classification Search

CPC ..... F28F 13/12; F28F 13/003; F28F 3/025; F28F 2275/12; F28F 2215/04; F28F 2215/08; F28F 3/044; F28F 3/027; F28F 3/046; F28F 3/048; B21D 53/04; B21D 28/02; B21D 53/022; F28D 1/0333; F28D 1/0341; F28D 1/0366; F28D 1/0375; F28D 1/0383

See application file for complete search history.

(56) References Cited

U.S. PATENT DOCUMENTS 6,039,112 A * 3/2000 Ruppel ..... F28D 9/005 165/109.1

2015/0000865 A1* 1/2015 Ueda ..... F02C 7/14 165/51

FOREIGN PATENT DOCUMENTS

WO WO-2020033139 A1 * 2/2020 ..... F28F 3/027

* cited by examiner

*Primary Examiner* — Jun S Yoo

(74) *Attorney, Agent, or Firm* — Jeroen Valensa; Michael Bergnach

(57) ABSTRACT

A heat exchanger has a turbulating insert arranged between a pair of plates. The turbulating insert is permeable to fluid flow in both a high-pressure-drop direction and a low-pressure drop direction. One portion of the turbulating insert has the high-pressure-drop direction oriented at a non-zero angle to the high-pressure-drop direction of another portion. A method of making the heat exchanger includes forming a turbulating insert, removing a portion of the turbulating insert to create a cavity within the turbulating insert, placing the remaining turbulating insert into a stamped first plate, and placing the removed portion of the turbulating insert into the cavity at a non-zero angle of rotation relative to the remaining turbulating insert.

9 Claims, 5 Drawing Sheets

HEAT EXCHANGER WITH TURBULATING INSERTS

BACKGROUND

Heat exchangers for efficiently transferring heat between fluid streams while maintaining physical separation between those fluid streams are known. Such heat exchangers are typically constructed from metal materials having a high thermal conductivity, such as alloys of aluminum or copper. In some cases one or more of the fluids are corrosive and/or at elevated pressure, requiring the use of materials such as titanium and stainless steel. All of these types of heat exchangers can be produced by brazing.

In order to increase the rate of heat transfer, turbulating inserts can be provided between the separating sheets or plates of the heat exchanger. The turbulating effect of the inserts tends to break up the fluid boundary layer as one of the fluid streams moves through the heat exchanger, thereby increasing the rate of convective heat transfer. However, the same effect also increases the resistance to flow, thereby increasing the pressure drop of the fluid through the heat exchanger. This is often non-desirable, as it leads to increased parasitic losses.

SUMMARY

A heat exchanger with turbulating inserts is constructed as a stack of stamped metal plates. The stamped metal plates can be arranged in pairs to define a fluid volume within each pair, through which a fluid to be heated or cooled (of both) can be circulated. The stack can include multiple such pairs of plates arranged to be fluidly in parallel with one another, so that the flow of fluid can be divided into multiple hydraulically parallel streams through the heat exchanger for the efficient exchange of heat energy.

The pairs of plates can be arranged as spaced-apart pairs separated from one another by dimples formed into the plates. Alternatively, the pairs of plates can be alternating pairs within a stack of nested plates. Another fluid can be directed to flow over external surfaces of the plates of each pair and can thereby exchange heat with the fluid flowing through the fluid volume of the plate pair in order to exchange heat therewith.

The fluid flowing through the fluid volume of the plate pair (the first fluid) can be higher in temperature than the fluid flowing over the outer surfaces of the plates of the pair (the second fluid), so that the first fluid is cooled by the second fluid as they each pass through the heat exchanger. Alternatively, the first fluid can be lower in temperature than the second fluid so that the first fluid is heated by the second fluid as they each pass through the heat exchanger. The heat exchanger can be used to heat the first fluid in some operating conditions and to cool the first fluid in other operating conditions.

A turbulating insert that is permeable to fluid flow in two orthogonal directions can be inserted within the fluid volume. Such a turbulating insert can be joined to the inwardly facing surfaces of the plates in order to provide a flow-permeable structural support within the plate pair, thereby strengthening the plate pair against deformation or rupture or both due to operation with a first fluid that is at a substantially high pressure. The turbulating insert can also be used to force a more uniform flow distribution through the fluid volume by imposing a pressure loss on the first fluid as it passes through the fluid volume. The turbulating insert can also turbulate the fluid flow in order to increase the convective heat transfer coefficient within the plate pair and can simultaneously provide additional surface area for convective heat transfer, thereby increasing the heat transfer efficiency of the heat exchanger.

The turbulating insert can be more permeable to fluid flow in one of the two orthogonal directions than in the other, so that the more permeable direction is a low-pressure-drop direction and the less permeable directions is a high-pressure-drop direction. In other words, the pressure drop that would be imposed upon a given mass flow rate of a fluid in the high-pressure-drop direction is substantially greater than the pressure drop that would be imposed upon the same mass flow rate of that fluid in the low-pressure-drop direction. By substantially greater is meant that the pressure drop in the high-pressure-drop direction is at least twice the pressure drop in the low-pressure-drop direction for the same mass flow rate of a fluid.

As the first fluid flows through a turbulating insert having such permeability, it can flow in both the low-pressure-drop direction and in the high-pressure-drop direction. Due to the lower flow resistance of the low-pressure-drop direction, the first fluid will flow more readily in that direction. This can, however, lead to less uniform flow distribution. In contrast, when the fluid is forced to flow through the turbulating insert in the high-pressure-drop direction, the higher resistance to fluid flow will tend to cause a more uniform flow distribution. In addition, the high-pressure-drop flow direction will tend to have a higher heat transfer coefficient due to the increased turbulation of the fluid flow, thereby leading to higher heat transfer efficiency.

It can be disadvantageous for the pressure drop of the fluid flowing through the turbulating insert to be too high, since this would require an increase in the amount of pumping power that must be supplied to the fluid and, consequently, tend to increase the parasitic losses of the system. Furthermore, an excessively high pressure drop can necessitate an increase in the overall pressure levels of the fluid, which can lead to a reduction in the useful life of the heat exchanger or other parts of the system due to increased pressure fatigue. Consequently, it is often desirable for pressure and pressure drop reasons to have the overall fluid direction through the turbulating insert to be in the low-pressure-drop flow direction. Conversely, for purposes of maximizing heat transfer efficiency it is often desirable to have the overall fluid direction through the turbulating insert to be in the high-pressure drop direction.

The plate pair can include more than one turbulating insert within the fluid volume. A first turbulating insert and a second turbulating insert can be arranged together within a single plate pair. Additional turbulating inserts can also be arranged therein, such as a third turbulating insert, a fourth turbulating insert, etc.

When more than one turbulating insert is arranged within a plate pair, the second turbulating insert can be arranged so that the low-pressure-drop direction of the second turbulating insert is arranged at a non-zero angle to the low-pressure drop direction of the first turbulating insert. The non-zero angle can be a ninety degree angle, so that the low-pressure-drop direction of the second turbulating insert is aligned with the high-pressure-drop direction of the first turbulating insert, or it can be less than a ninety degree angle, such as a thirty degree angle, a forty-five degree angle, a sixty degree angle, or some other angle. In this manner, a desirable compromise between the trade-offs of low pressure drop and high heat transfer can be achieved.

The heat exchanger can include an inlet manifold and an outlet manifold for the first fluid. The inlet and outlet manifolds can each extend through the stack of plate pairs, and can be fluidly connected to each other within the heat exchanger by the fluid volumes contained within each plate pair. At least one of the turbulating inserts arranged within a given plate pair can be provided with an aperture through which the inlet manifold or the outlet manifold extends, so that the first fluid can flow from the inlet manifold to the turbulating insert or from the turbulating insert to the outlet manifold. In some cases one turbulating insert has a first such aperture through which the inlet manifold extends, and a second such aperture through which the outlet manifold extends. In other cases, one turbulating insert has an aperture through which the inlet manifold extends and another turbulating insert has an aperture through which the outlet manifold extends.

The heat exchanger and the plates that form the heat exchanger can have a shape that is longer in one direction than it is in a second direction perpendicular to the one direction, the longer direction being defined as the longitudinal direction of the heat exchanger. In order to maximize the heat transfer effectiveness of the heat exchanger, it can be advantageous for the overall flow direction of the first fluid through the fluid volume of a plate pair to be at least partially aligned, and preferably substantially aligned, with the longitudinal direction of the heat exchanger. To that end, the inlet and outlet manifolds and be arranged at opposing ends of the heat exchanger in the longitudinal direction. The inlet manifolds can be arranged along a line that extends parallel to the longitudinal direction, so that the overall flow direction of the first fluid flow through the plate pair is aligned with the longitudinal direction. They can alternatively be arranged in opposing corners of the heat exchanger, so that the overall flow direction of the first fluid through the heat exchanger is substantially (but not completely) aligned with the longitudinal direction of the heat exchanger.

A method of making a heat exchanger can include forming a turbulating insert, removing a portion of the turbulating insert to create a cavity within the turbulating insert, and placing the remaining turbulating insert into a stamped first plate. The removed portion of the turbulating insert can be placed into the cavity, and a stamped second plate can be joined to the stamped first plate to enclose the turbulating insert within a fluid volume created between the stamped first plate and the stamped second plate.

The removed portion of the turbulating insert can be placed into the cavity at a non-zero angle of rotation relative to the remaining turbulating insert. For example, the removed portion can be placed at a ninety degree angle of rotation, or it can be less than a ninety degree angle, such as a thirty degree angle, a forty-five degree angle, a sixty degree angle, or some other angle.

The removed portion can have a shape that exhibits rotational symmetry, such as a square shape, a hexagonal shape, an octagonal shape, an equilateral triangle shape, etc. In this manner, the removed portion can be rotated by an angle that corresponds to the angle of rotational symmetry and can be reinserted within the cavity at that angle without creating large gaps between the removed portion and the remaining portion.

DETAILED DESCRIPTION

Figure 1:
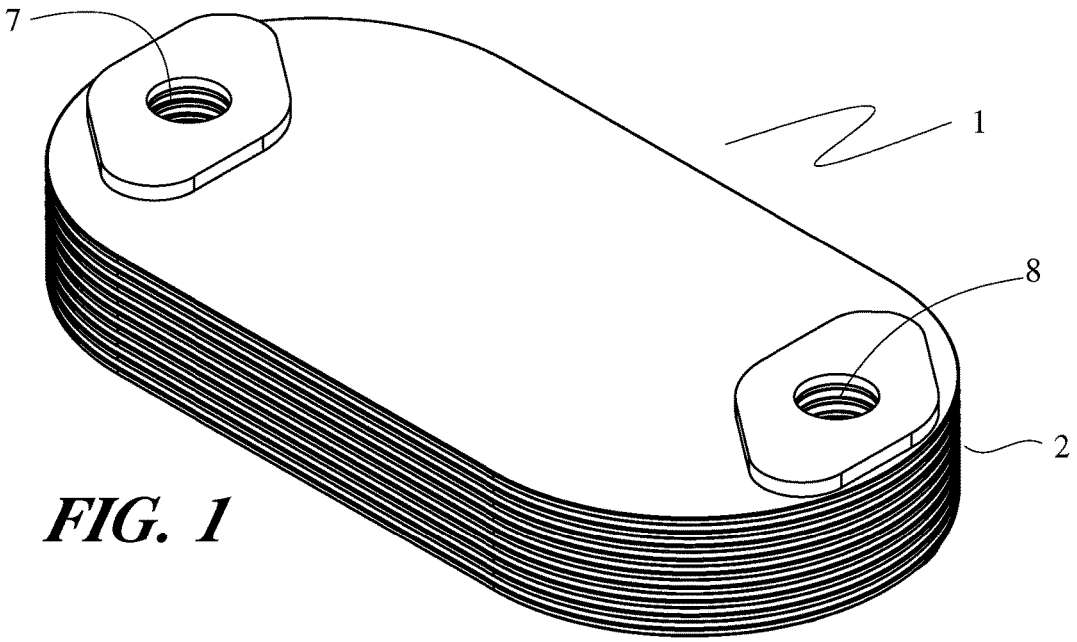
FIG. 1 is a perspective view of a heat exchanger according to an embodiment of the invention.
Figure 2:
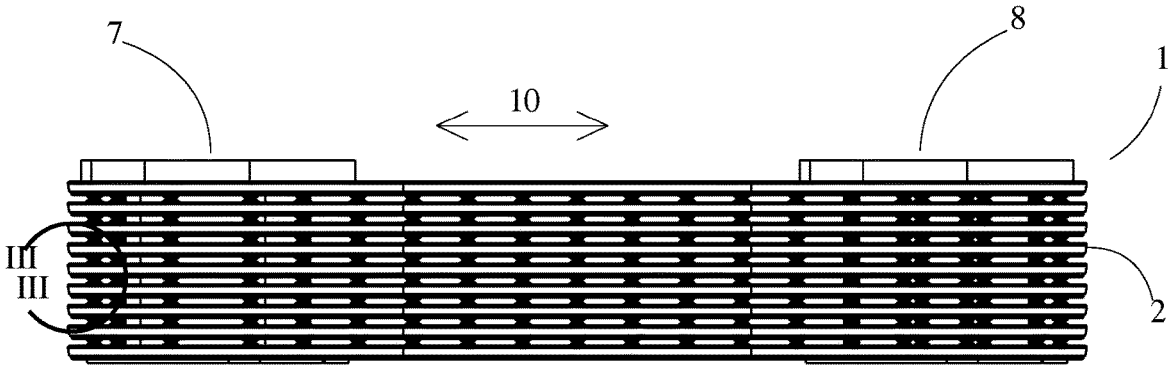
FIG. 2 is a side view of the heat exchanger of FIG. 1.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," and "coupled" and variations thereof are used broadly and encompass both direct and indirect mountings, connections, supports, and couplings. Further, "connected" and "coupled" are not restricted to physical or mechanical connections or couplings.

A heat exchanger 1 is constructed as a stack formed from stamped plates 2 arranged in pairs. An inlet manifold 7 and an outlet manifold 8 each extend through the stack. A flow of fluid to be heated or cooled within the heat exchanger 1 is directed into the heat exchanger 1 by way of the inlet manifold 7, and is directed to flow through fluid volumes arranged within the plate pairs. After having been heated or cooled, the flow of fluid is removed from the heat exchanger 1 by way of the outlet manifold 8. The inlet manifold 7 and the outlet manifold 8 are arranged at opposing ends of the heat exchanger 1 along a longitudinal direction 10 of the heat exchanger 1.

Figure 3:
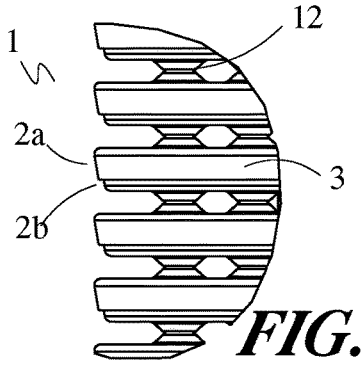
FIG. 3 is a detail view of the portion of FIG. 2.

As shown in detail in FIG. 3, each of the plate pairs is defined by a stamped plate 2*a* and a stamped plate 2*b* that are assembled together to create a fluid volume 3 within the plate pair through which the fluid to be heated or cooled can flow from the inlet manifold 7 to the outlet manifold 8. The plates 2*a*, 2*b* have formed outer flanges that cooperate with one another to seal the fluid volume 3 within the plate pair. The outer flange of the plate 2*a* surrounds and receives the outer flange of the plate 2*b* to create the sealed fluid volume 3.

The plates 2 are provided with dimples 12 formed therein to space apart adjacent ones of the plate pairs, so that gaps are provided therebetween to allow for the flow of another fluid over outer surfaces of the plates 2. In this manner the heat exchanger 1 can function to transfer heat between a first fluid that flow through the plate pairs and a second fluid that flows over the outer surfaces of the plate pairs. The heat exchanger 1 can, for example, be mounted within a housing through which the second fluid flows.

As one non-limiting example, the heat exchanger 1 can be an engine oil cooler. In such an application, engine oil can be circulated through the plate pairs of the heat exchanger 1 as the first fluid, and a flow of coolant can be directed through a housing within which the heat exchanger 1 is mounted in order to cool the engine oil.

Figure 4:
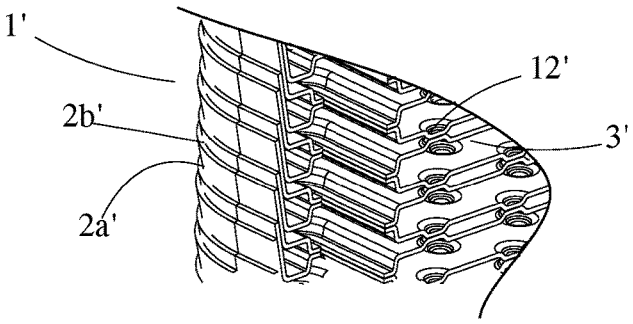
FIG. 4 is a sectioned detail view of a heat exchanger showing an alternative embodiment of the invention.

FIG. 4 depicts a construction detail of a heat exchanger 1' having an alternative construction. Similar to the heat exchanger 1, the heat exchanger 1' is constructed as a stack of stamped metal plates. The metal plates of the heat exchanger 1' are arranged as stack of nested shells, so that both the first fluid and the second fluid are enclosed by plates arranged in pairs. Plates 2*a*' and 2*b*' are arranged in alternating sequence, so that the first fluid flows within a fluid volume 3' formed by a pair of plates, each such pair of plates defined by a plate 2*a*' and a plate 2*b*' nested therein. The next plate 2*a*' is likewise nested within that plate 2*b*' to form a plate pair for the second fluid, and so on throughout the stack, so that flow passages for the first and second fluids are alternatingly arranged within the stack in a similar fashion as was the case for the heat exchanger 1. Dimples 12' extending outwardly (i.e. away from the fluid volume 3') from the plates 2*a*', 2*b*' are also provided.

Figure 5:
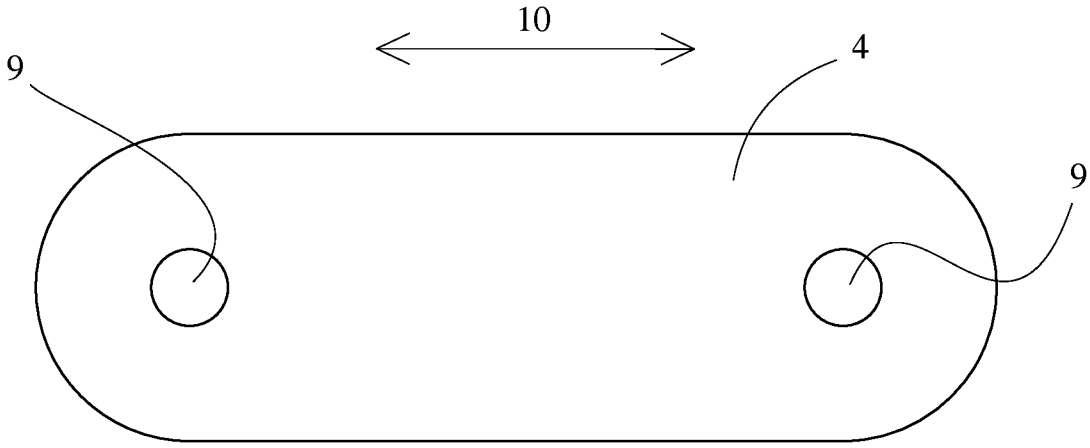
FIG. 5 is a plan view of a turbulating insert for use in the heat exchanger of FIG. 1.

A turbulating flow insert 4 (shown generally in FIG. 5) is arranged within each of the fluid volumes 30. The turbulating insert 4 can be provided as multiple pieces, as will be described in greater detail. Generally speaking, the turbulating insert 4 functions to provide both structural support and flow turbulation for the fluid passing through the fluid volume 3. The outer profile of the turbulating insert 4 is shaped to conform to the shape of the stamped plate 2 into which it is to be inserted, so that generally the entire fluid volume 3 is filled with the turbulating insert 4. By way of example, the outer profile can be cut, punched, or otherwise formed in the turbulating flow insert after first producing the turbulating flow insert as a larger piece. Apertures 9 are additionally cut, punched, or otherwise formed into the turbulating insert 4, so that the fluid manifolds 7, 8 can extend through the plate pairs in order to fluidly communicate with the fluid volumes 3.

In the construction of the heat exchanger 1 or 1', a turbulating insert 4 is placed into a plate 2*b* or 2*b*', and a plate 2*a* or 2*a*' is subsequently assembled to the plate 2*b* or 2*b*' to form the completed plate pair. This can be repeated as necessary to form the multiple plate pairs of the heat exchanger stack, after which the completed stack is joined by brazing.

Figure 6:
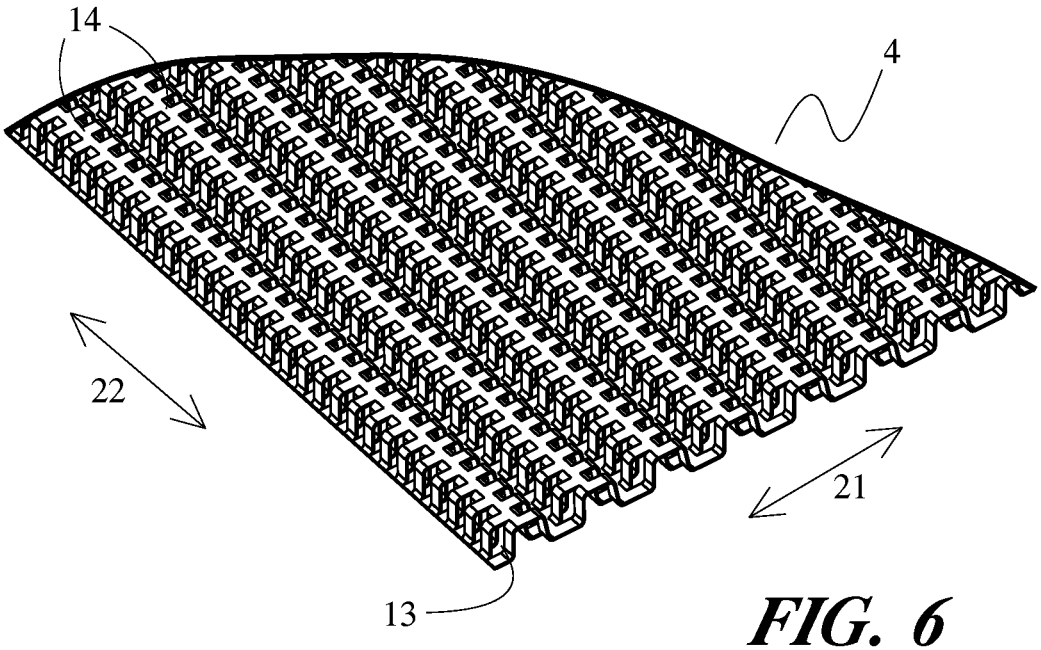
FIG. 6 is a partial perspective view of a style of insert that can be particularly useful as the turbulating insert of FIG. 5.

An exemplary style of a turbulating insert 4 is depicted in FIG. 6. The turbulating insert 4 as shown in FIG. 6 is of a lanced and offset type, and is constructed by rolling or stamping a continuously fed sheet of thin metal material. Lances are formed into the material and the resulting strands of material are offset from the plane of the material in successively opposing directions to form openings 13 through which the fluid can pass. Corrugations 14 are subsequently formed into the material at a height that corresponds to the height of the fluid volume 3, so that crests and troughs of the corrugations 14 can be joined to the stamped plates 2.

As a result of the forming operations, the insert 4 is permeable to fluid flow in two orthogonal directions, indicated in FIG. 6 by the arrows 21 and 22. The direction indicated as 22, extending along the lengths of the corrugations 14, will be much less resistant to fluid flow than the direction indicated as 21, since fluid flowing in the direction 21 will need to flow perpendicular to the corrugations 14 through the openings 13 that are formed by the lances. The direction 22 is therefore generally referred to as the high-pressure-drop direction of flow, and the direction 21 is generally referred to as the low-pressure-drop direction of flow.

Figure 7:
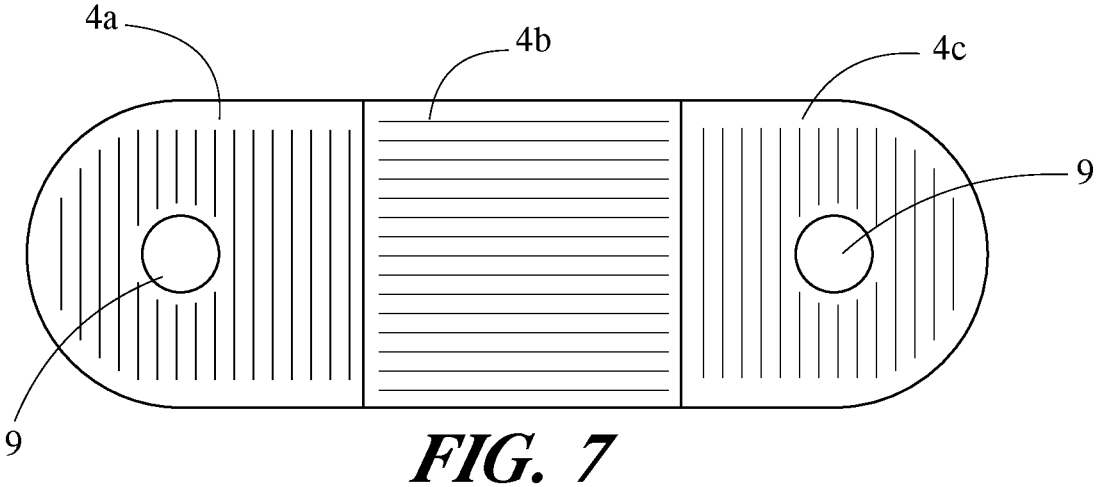
FIG. 7 is a plan view showing additional details of the turbulating insert of FIG. 5.

As shown in FIG. 7, the insert 4 can be constructed of multiple pieces. The exemplary insert 4 of FIG. 7 is constructed of three separate pieces, labeled 4*a*, 4*b*, and 4*c*. The piece 4*b* is arranged between the pieces 4*a* and 4*c* along the longitudinal direction, and the apertures 9 are provided within the outer pieces 4*a* and 4*c* so that fluid flowing through the turbulating insert 4 from the inlet manifold 7 to the outlet manifold 8 will necessarily pass through all three pieces.

The flow turbulation features of the turbulating insert are not depicted in detail in FIGS. 7-11, but lines corresponding to the corrugations 14 are used to generally depict the low-pressure-drop direction. Thus, a fluid flowing through the turbulating inserts from one of the apertures 9 to the other of the apertures 9 will first flow through one of the inserts 4*a*, 4*c* in a direction that is generally aligned with the low-pressure-drop direction of that insert piece, then through the insert 4*b* in a direction that is aligned with the high-pressure-drop direction of that insert piece, and then finally through the other of the inserts 4*a*, 4*c*, again in a direction that is generally aligned with the low-pressure-drop direction of that insert piece.

One advantage of the turbulating insert as embodied in FIG. 7 is that both the uniformity of flow distribution along the width of the fluid volume 3 (i.e. in the direction that is perpendicular to the longitudinal direction 10) and the rate of heat transfer within the central portion of the plate pair can be enhanced without imposing the undesirable large pressure drop that would result from the entirety of the turbulating insert having its high-pressure-drop direction aligned with the longitudinal direction.

The design of FIG. 7 allows for the use of differing geometries of the detailed turbulating inserts features for the three pieces. For example, the pitch and width of the corrugations or the strand width of the offset features can be different for the piece 4*b* than it is for the pieces 4*a* and 4*c*, thereby allowing the heat exchanger designer to optimize the balance between heat transfer and pressure drop to be most desirable. Such a variation between the insert details can provide disadvantages as well, however, in that it complicates the manufacturing of the heat exchanger 1 by requiring additional machine setup and operation for the different insert geometries.

Figure 8:
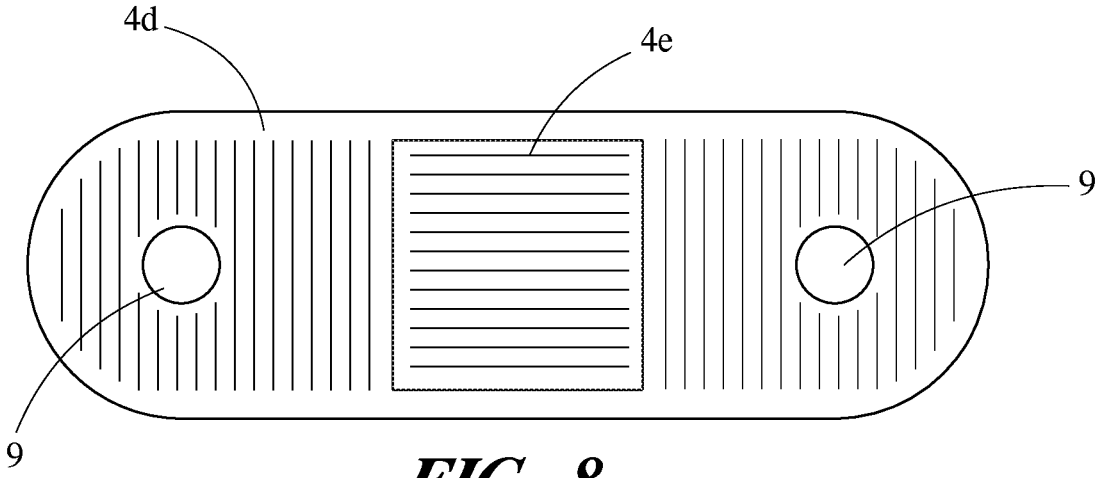
FIG. 8 is a plan view showing alternative additional details of the turbulating insert of FIG. 5.

In light of the foregoing, it can be especially advantageous to produce the turbulating insert as a single piece, then removing a portion of that piece and reinserting it with the low-pressure-drop direction oriented at an angle to its original orientation. FIG. 8 depicts an embodiment of the turbulating insert with a two-part turbulating insert having a first piece 4*d* and a second piece 4*e*, with the piece 4*e* arranged within the piece 4*d*. As again indicated by the lines within each of the pieces, the low-pressure-drop direction of the piece 4*e* is oriented to be perpendicular to the low-pressure-drop direction of the piece 4*d*, so that the high-pressure-drop direction of the piece 4*e* is aligned with the low-pressure-drop direction 4*d* in the longitudinal direction.

Figure 10A:
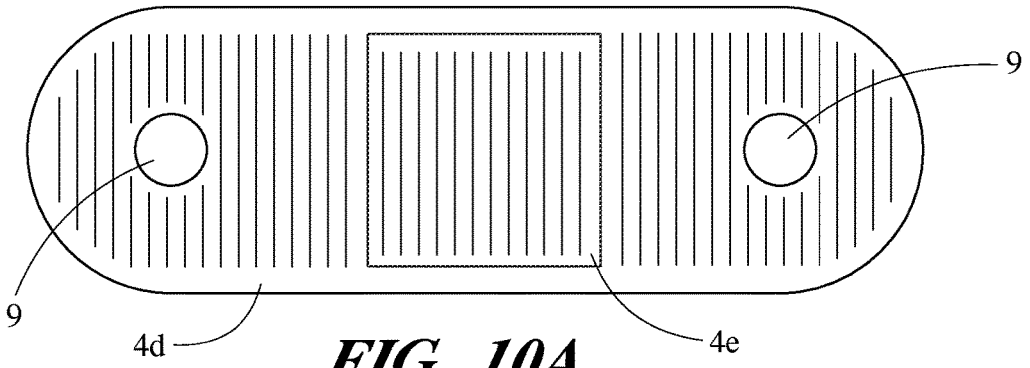
FIGS. 10A-C are a series of plan views showing several steps in the construction of the turbulating insert of FIG. 5 according to an embodiment of the invention.
Figure 10B:
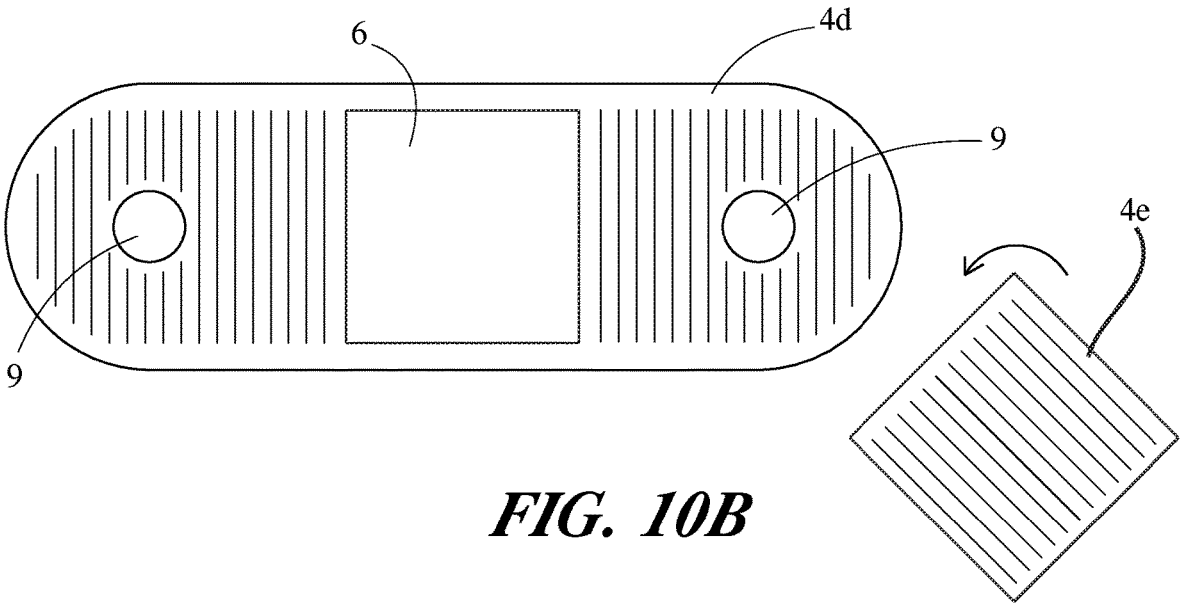
Figure 10C:
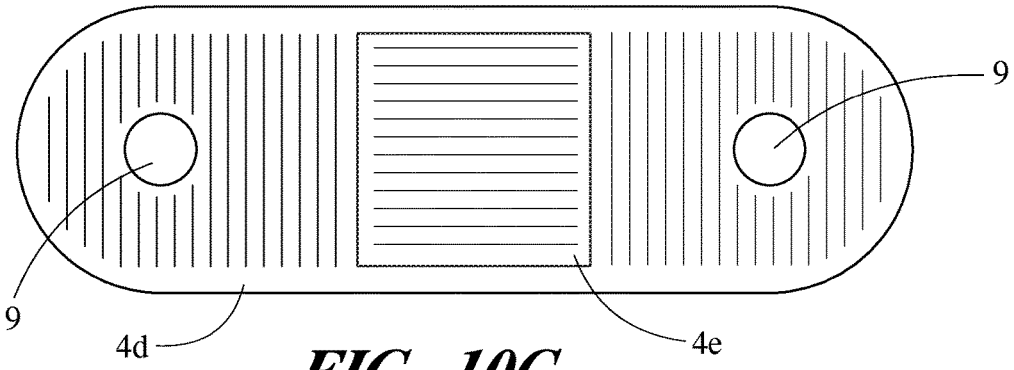

The piece 4*e* is advantageously shaped as a square, so that it has rotational symmetry. This allows for the turbulating insert to be first manufactured as a single part. A portion of the manufacturing sequence for the turbulating insert of FIG. 8 is depicted in FIGS. 10A-C. After having first produced the turbulating insert as a sheet (for example, as depicted in FIG. 6), the outer profile of the turbulating insert and the apertures 9 are formed into the sheet by, for example, a punching operation. In the same or a subsequent operation, the piece 4*e* can be punched out of the turbulating insert, leaving the piece 4*d* with a cavity 6 the same size as the piece 4*e*. The piece 4*d* is recovered and is rotated by the angle of rotational symmetry (in this case, ninety degrees) or a multiple thereof, and is subsequently re-inserted into the cavity 6 to form the completed turbulating insert, with essentially no gaps between the insert pieces.

Figure 9:
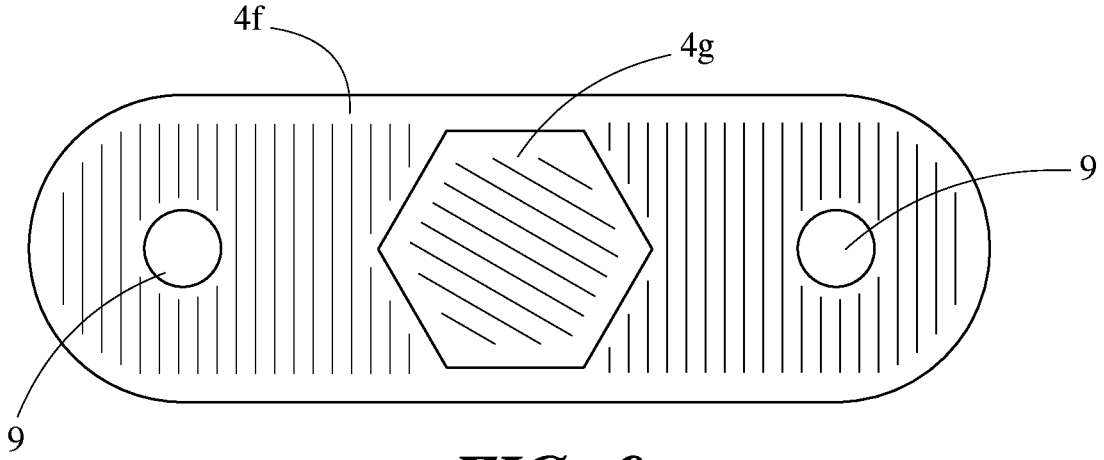
FIG. 9 is a plan view showing other alternative additional details of the turbulating insert of FIG. 5.

FIG. 9 depicts an alternative embodiment with a different angle of rotational symmetry. In that embodiment, a hexagonally shaped turbulating insert piece 4*g* is inserted into the hexagonally shaped cavity of a turbulating insert piece 4*f* at a sixty degree angle of rotation. It should be understood that the embodiments of FIG. 8 and FIG. 9 depict just two of the many shapes of insert pieces that can be used. Rotationally symmetrical insert pieces with more or fewer sides (e.g. three, five, seven, or more sides) can be used in a similar manner to that shown and described. It should also be understood that multiple pieces of the turbulating insert can be removed and reinserted to adjust the pattern of fluid flow through the turbulating insert.

The turbulating insert can be assembled into the plate pair in parts. For example, the piece 4*d* can be first inserted into one of the plates 2 of the plate pair (for example, the plate 2*b* or 2*b*'), and the second piece 4*e* can then be inserted into the cavity 6 before the other plate 2 of the plate pair (for example, the plate 2*a* or 2*a*') is assembled to form the completed plate pair.

Figure 11A:
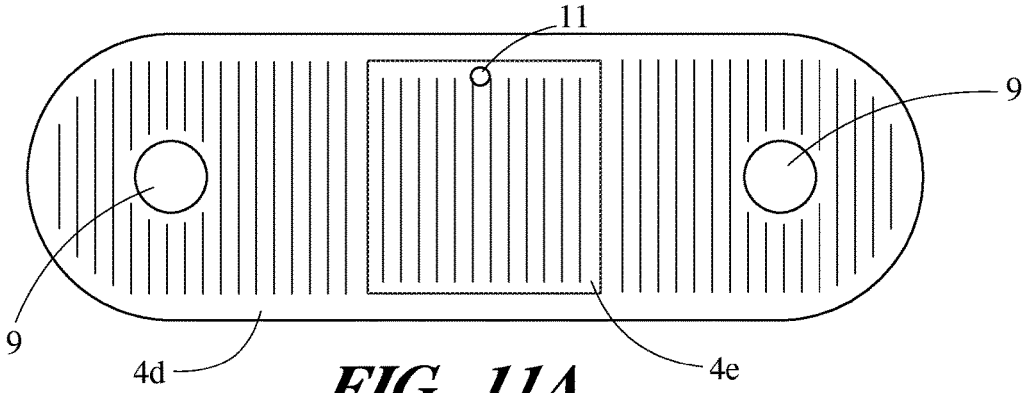
FIGS. 11A-C are a series of plan views showing several steps in the construction of the turbulating insert of FIG. 5 according to another embodiment of the invention.
Figure 11B:
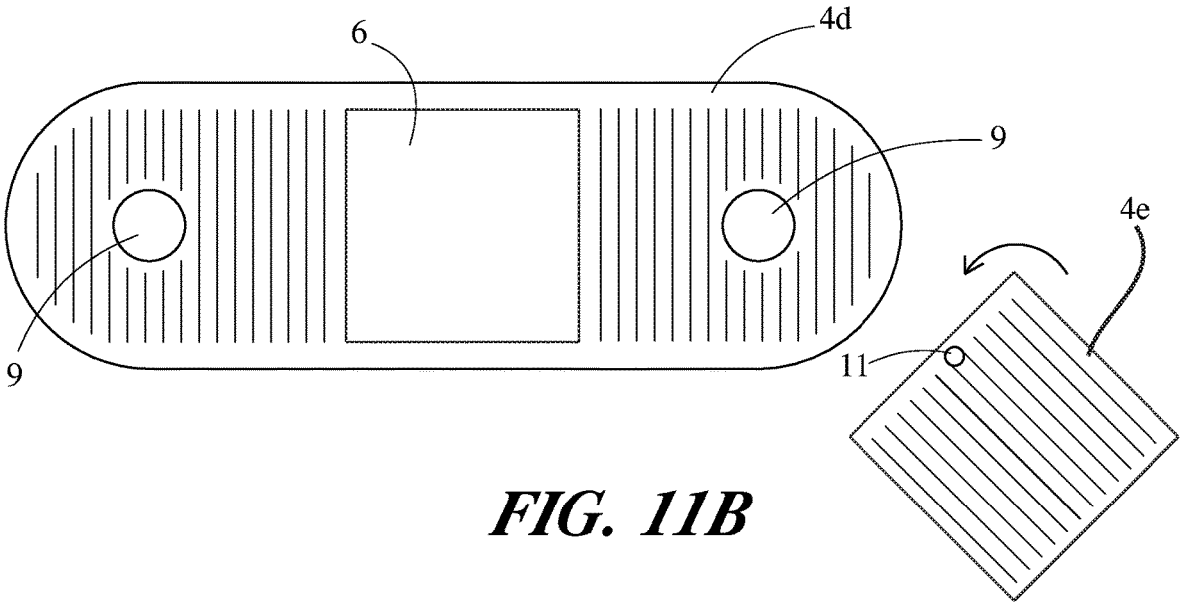
Figure 11C:
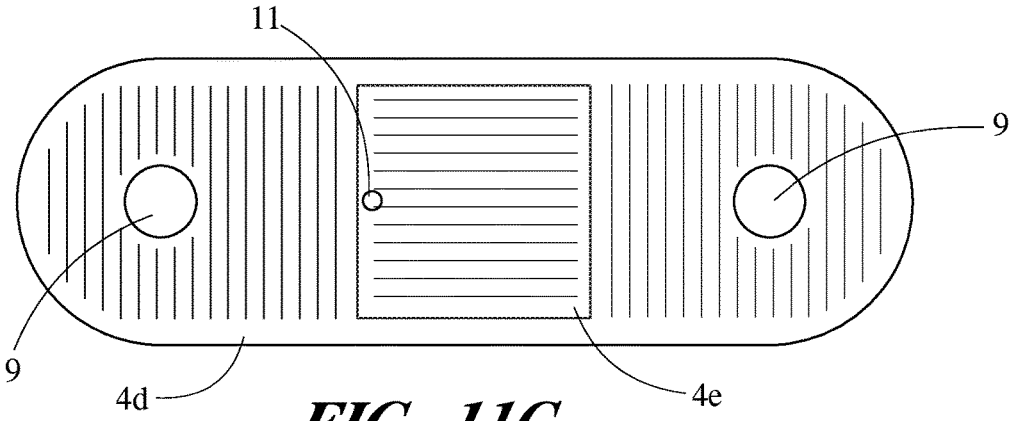

In order to aid in the assembly, and to ensure that the flow directions of the turbulating insert pieces are appropriately aligned, an alignment feature can be incorporated into one or more of the pieces of the turbulating insert. FIGS. 11A-C depict a variation of the embodiment depicted in FIGS. 10A-C that includes forming a locating hole 11 into the piece 4*e* at a location offset from the center of the piece 4*e*. A locating projection such as a dimple (not shown) can be formed in the plate 2 into which the turbulating insert is to be assembled, at a location corresponding to the location where the locating hole 11 will be when the piece 4*e* is properly oriented. Although the piece 4*e* could be reinserted into the cavity 6 in four possible orientations, the locating projection of the plate 2 would prevent the insertion of the piece 4*e* in any orientation except the desired one, thus ensuring that the low-pressure-drop directions and high-pressure-drop directions of the turbulating insert pieces are properly oriented.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A method of making a heat exchanger, comprising:
forming a turbulating insert;
removing a portion of the turbulating insert to create an aperture within the remaining turbulating insert;
placing the remaining turbulating insert into a stamped first plate;
placing the removed portion of the turbulating insert into the aperture of the remaining turbulating insert; and
joining a stamped second plate to the stamped first plate to enclose the turbulating insert within a fluid volume created between the stamped first plate and the stamped second plate.

2. The method of claim 1, wherein the removed portion of the turbulating insert is placed into the aperture at a non-zero angle of rotation relative to the remaining turbulating insert.

3. The method of claim 2, wherein the non-zero angle is ninety degrees.

4. The method of claim 1, wherein the removed portion of the turbulating insert exhibits rotational symmetry.

5. The method of claim 4, wherein the removed portion of the turbulating insert has a square shape.

6. The method of claim 1, further comprising:
forming a locating hole into the removed portion of the turbulating insert; and
using the locating hole to orient the removed portion of the turbulating insert within the aperture at a non-zero angle of rotation relative to the remaining turbulating insert.

7. The method of claim 6, wherein using the locating hole to orient the removed portion of the turbulating insert within the aperture includes receiving a projection formed into the stamped first plate into the locating hole.

8. The method of claim 1, wherein joining a stamped second plate to the stamped first plate includes either overlapping an outer perimeter of the first plate with an outer perimeter of the second plate or nesting the outer perimeter of the second plate within the outer perimeter of the first plate.

9. The method of claim 1, wherein forming the turbulating insert includes lancing and offsetting a metal sheet at regular intervals and rolling the metal sheet to create corrugations.

* * * * *